United States Patent [19]

Genakis

[11] 3,943,739

[45] Mar. 16, 1976

[54] PIN TUMBLER LOCK

[76] Inventor: Joseph M. Genakis, 948 W. Boylston St., Worcester, Mass. 01606

[22] Filed: Apr. 3, 1974

[21] Appl. No.: 457,586

[52] U.S. Cl. ..... 70/419; 70/364 A; 70/372; 70/375

[51] Int. Cl.[2] ..... E05B 63/00

[58] Field of Search ..... 70/419, 364 A, 362, 372, 70/421, 375

[56] References Cited

UNITED STATES PATENTS

| | | | |
|---|---|---|---|
| 621,875 | 3/1899 | Voight | 70/419 |
| 2,049,548 | 8/1936 | Swanson | 70/364 A |

FOREIGN PATENTS OR APPLICATIONS

| | | | |
|---|---|---|---|
| 449,029 | 6/1936 | United Kingdom | 70/419 |

*Primary Examiner*—Robert L. Wolfe
*Attorney, Agent, or Firm*—Charles R. Fay

[57] ABSTRACT

A pin tumbler lock comprising a plug with top and bottom pins operable by a key, said plug being surrounded by an enclosure which may be alternatively a rotary sleeve for grand mastering or the cylinder of a lock. The sleeve or cylinder as the case may be is provided with a longitudinal recess in which is mounted alternatively one or more rotationally movable baffle inserts or slide pieces for each tumbler. These inserts are apertured for receiving the pins. Where the sleeve is present there is a recess at the internal surface thereof receiving the inserts and there is also a similar recess in the cylinder receiving inserts on the interior surface of the cylinder. These inserts may be circumferentially slidable or rotational.

4 Claims, 24 Drawing Figures

PIN TUMBLER LOCK

Attention is directed to copending application Ser. No. 345,330, filed Mar. 27, 1973 and now abandoned, and Ser. No. 443,328, filed Feb. 19, 1974.

BACKGROUND OF THE INVENTION

Many attempts have been made to design pickproof pin tumbler locks but in the past the locks have had deficiencies which are cured by the present invention, and at the same time the present invention presents a design which is extremely simple and inexpensive, but also highly versatile and efficient. This invention also has substantially all of the advantages of the inventions appearing in the copending applications above identified.

SUMMARY OF THE INVENTION

A cylinder or other enclosure contains a plug, there being a sleeve surrounding the plug within the cylinder. The plug is provided with the usual pinways having the bottom and top pins located therein. The bottom pins, when master keyed, are made in sections; and normally in locked condition the topmost portion of the bottom pin extends outwardly of the plug and is located in an apertured insert in turn located in a recess in the sleeve at the internal surface.

The top pins are spring-pressed as usual against the bottom pins, and the top pins may also be made in sections, the lowermost section of which may extend through the sleeve into the recess with the insert.

The recesses may be wider circumferentially than are the inserts so that there is an offset circumferential sliding motion with the bottom pins, (and also the top pins) rendering the lock unable to be opened in the event of a pick being used to raise any individual bottom pin.

There may be a single insert for each of the top and bottom pins, or on the other hand one insert may be arranged with a multiple series of apertures therein to receive the top and bottom pins for the normal operation of the lock by the key, different keys being used to turn the plug and the sleeve together, or plug separately. The inserts may be multiple for additional safety against picks, and also rotational inserts may be used as an alternative.

PREFERRED EMBODIMENTS OF THE INVENTION

Figure 1:
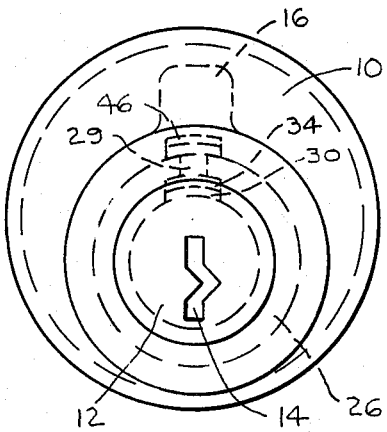
FIG. 1 is a view in front elevation showing the plug, sleeve, and cylinder.

A cylinder or enclosure 10 contains a plug 12 having keyway 14. The plug 12 may have the usual cam 16. The cylinder is provided with pinways as at 18 for the top pins, and the plug is provided with pinways as at 20 for the bottom pins, the latter being multiple as at 21, 22, and 23. A freely rotating ball 24 may be utilized at the lower end of the pins if desired.

Figure 2:
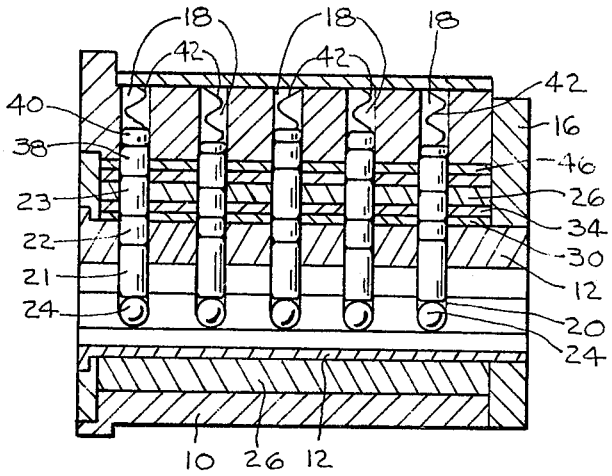
FIG. 2 is a longitudinal section thereof.
Figure 3:
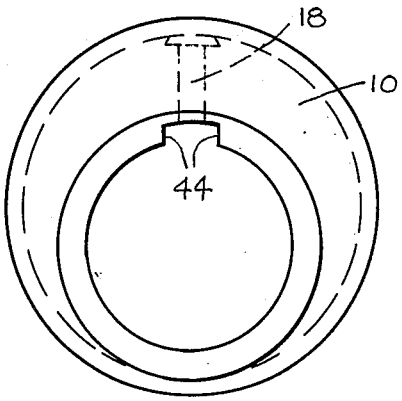
FIG. 3 is a front view of the cylinder.
Figure 4:
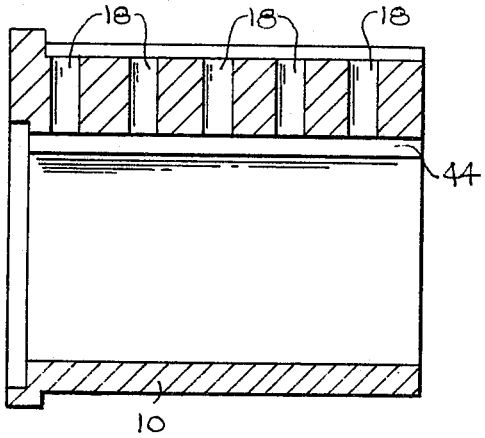
FIG. 4 is a longitudinal section thereof.
Figure 5:
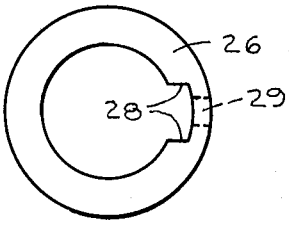
FIG. 5 is a front view of the sleeve.
Figure 6:
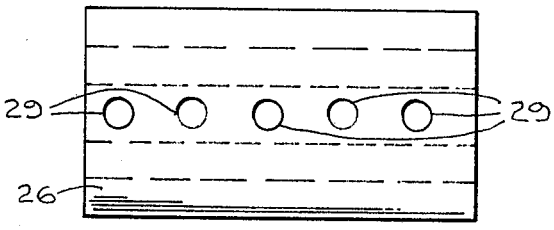
FIG. 6 is a top plan view thereof.
Figure 8:
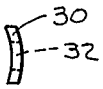
FIG. 8 is an end view thereof.
Figure 7:
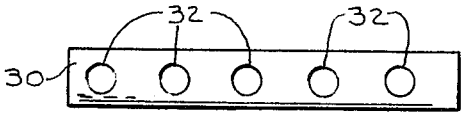
FIG. 7 is a plan view of an insert.
Figure 13:
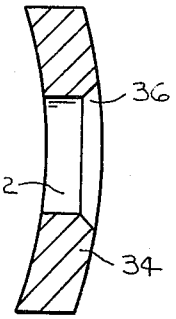
FIG. 13 is an enlarged transverse section through an insert.
Figure 12:
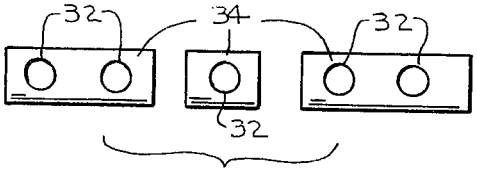
FIG. 12 is a plan view of a divided insert.

Surrounding the plug there is a solid sleeve 26. This sleeve 26 extends almost the length of the lock and closely fits the plug being rotatable with respect thereto. The sleeve 26 has a longitudinal groove or recess 28 therein at the interior surface thereof, this recess extending the full length of the sleeve to a position adjacent the rearward portion thereof, practically the full length of the sleeve, as shown in FIG. 2. In this recess there is positioned a single insert 30 with multiple apertures 32, or a plurality of lesser inserts 34 also apertured for reception of the pins.

It will be seen that the recess 28 is wider than the inserts, and thus the inserts are circumferentially slidable sufficiently to prevent picking, as will be described. The inserts may be plural, as seen at 34, and more than the two shown can also be used. This enhances the safety of the lock. The top insert is preferably beveled at its top, as at 36, to ensure reception of the top pin, preventing ledging of the locking pins.

Figure 10:
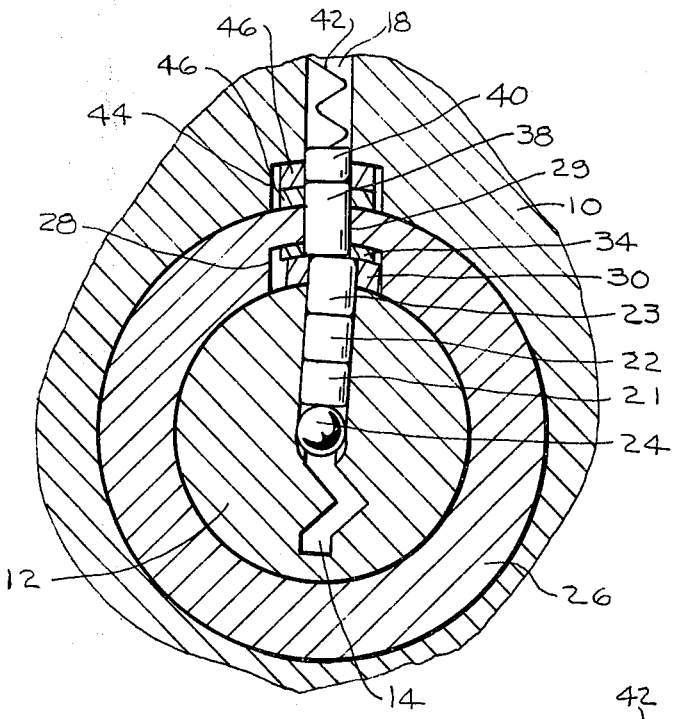
FIGS. 9, 10, and 11 illustrate actions of the lock on an enlarged scale.
Figure 9:
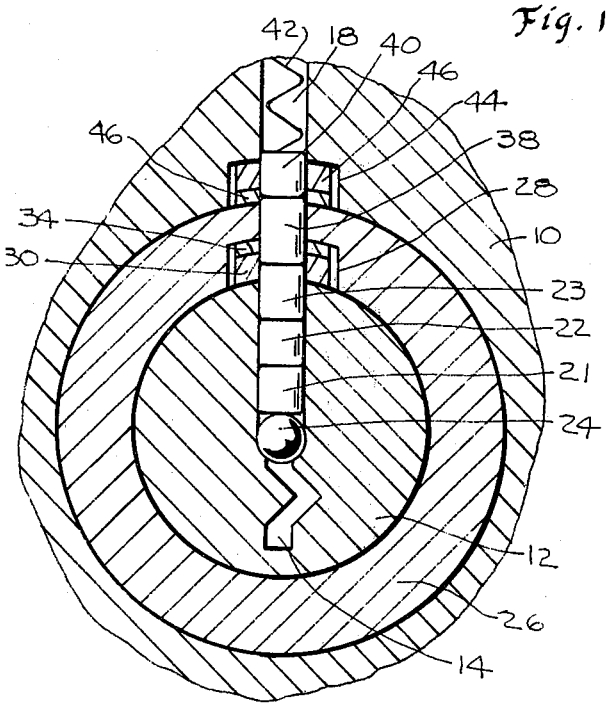

The slight rotary motion of the plug and insert within the sleeve achieves prevention of further lifting of the pin by a pick, as shown in FIG. 10, and by this means prevents picking of the lock inasmuch as the bottom pins must be able to react against the top pins which are indicated at 38 and 40, the top pin also preferably being multiple and being backed by spring 42 in the usual manner.

The cylinder has a groove or recess longitudinally thereof as indicated at 44 and this is similar to the groove 28. In this groove there is positioned a slidable insert or inserts 46 which may be similar to those at 30 and 34 having apertures therein for the reception of the top pins as clearly shown. Here again the groove or recess 44 is wider than the sliding insert for the same purpose to create another shoulder preventing further lifting of the pins, FIG. 11, and for the same purpose as is provided by the shoulder between the plug and the sleeve, FIG. 10.

The provision of the sleeve and of the sliding pieces greatly increases the numbers of combinations possible which are opened by a series of keys providing the two shear points, and this enhances the picking difficulty.

Figure 11:
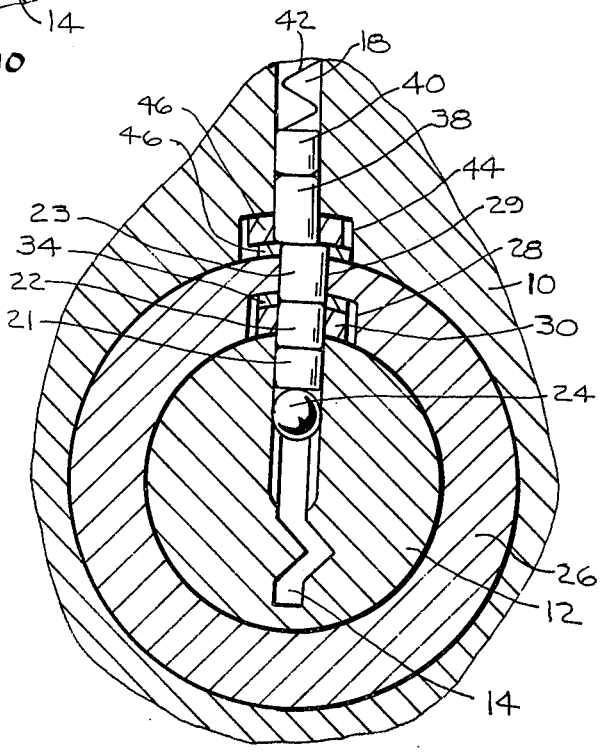
Figure 14:
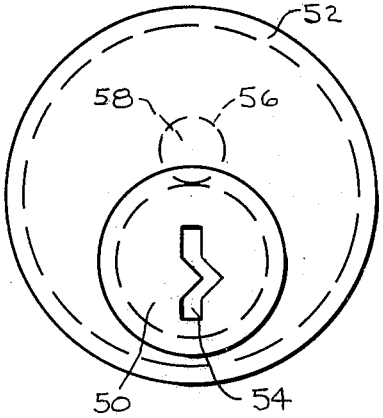
FIG. 14 is a front view of a modification.
Figure 15:
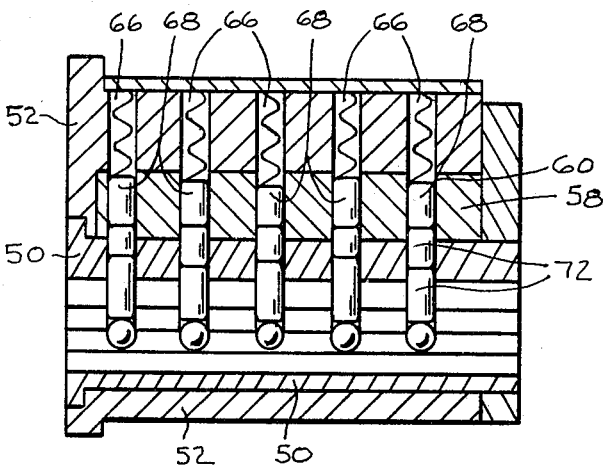
FIG. 15 is a longitudinal section thereof.
Figure 17:
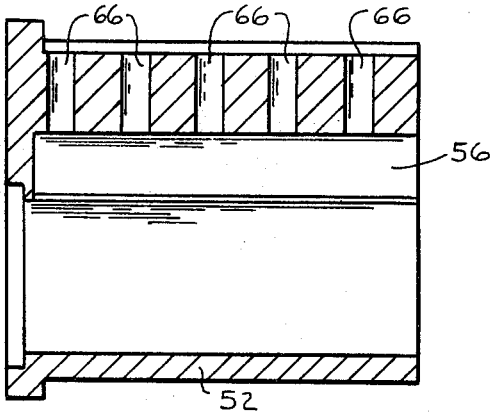
FIG. 17 is a longitudinal section thereof.
Figure 16:
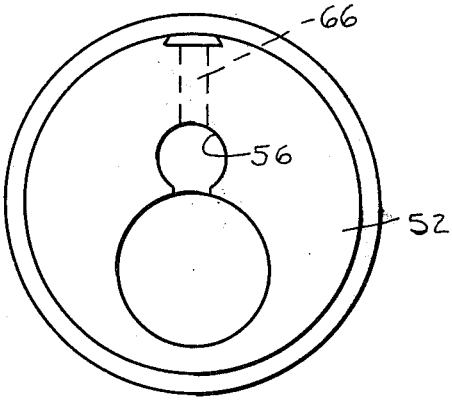
FIG. 16 is a front view of the cylinder thereof.
Figure 18:
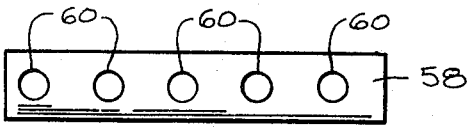
FIG. 18 is a plan view of the insert.
Figure 19:
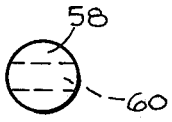
FIG. 19 is an end view thereof.
Figure 20:
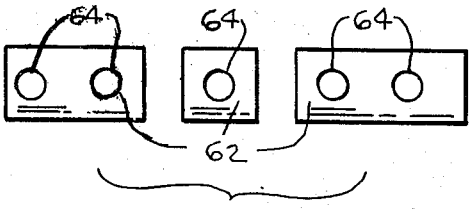
FIG. 20 is a plan view of a divided insert.
Figure 21:
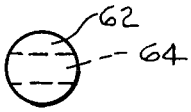
FIG. 21 is an end view thereof.

The disclosure shows a construction that is capable of operation either right or left but illustrated in FIGS. 10 and 11 as the right-hand operation. The inserts are shown convexo-concave to suit the surfaces they are applied to, but they could also be flat.

In the form of the invention shown in FIGS. 14 to 24 inclusive, there is a plug 50 in a cylinder 52. The plug 50 has a keyway 54. In the cylinder there is a longitudinal bore 56 adjacent the plug and there is an insert 58 in the bore. This insert is provided with pinways 60. The insert may be made in a single piece, see FIG. 18, or in a plurality of pieces, see 62 in FIG. 20. The pieces 62 have pinways 64.

The cylinder has pinways 66 accommodating top pins 68, see FIG. 15 and FIGS. 22 to 24, the top pin 68 at times being wholly located in the pinways 60 in the insert 58. The top pins are indicated at 68 and the bottom pins in pinways 70 and plug 50 are indicated at 72.

Figure 23:
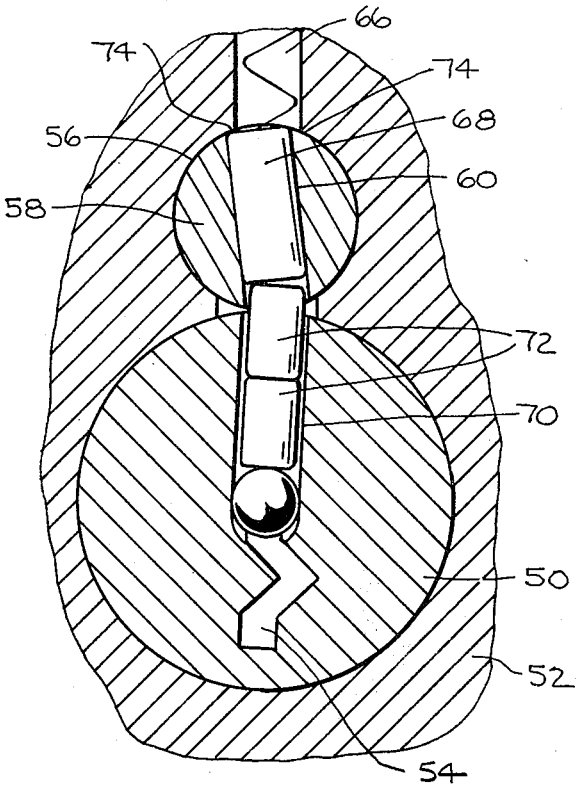

Referring now to FIG. 23, when the lock is attempted to be picked and the pick is used to raise the bottom pins and turned slightly as is usual, the lock picking the insert 58 will rotate slightly in a counterclockwise direction and the top pin 68 will abut shoulder 74 which is formed between pinways 66 and the bore 56.

Figure 22:
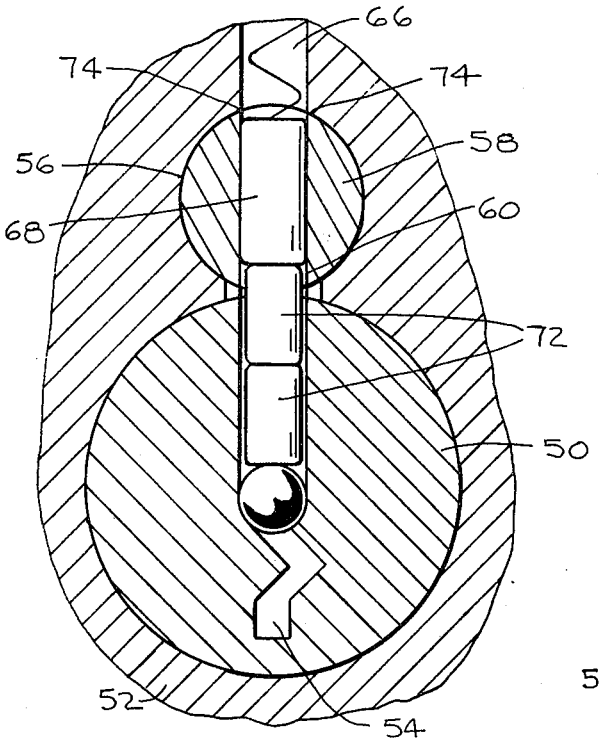
FIGS. 22, 23, 24 illustrate actions of the lock of FIG. 14, on an enlarged scale.
Figure 24:
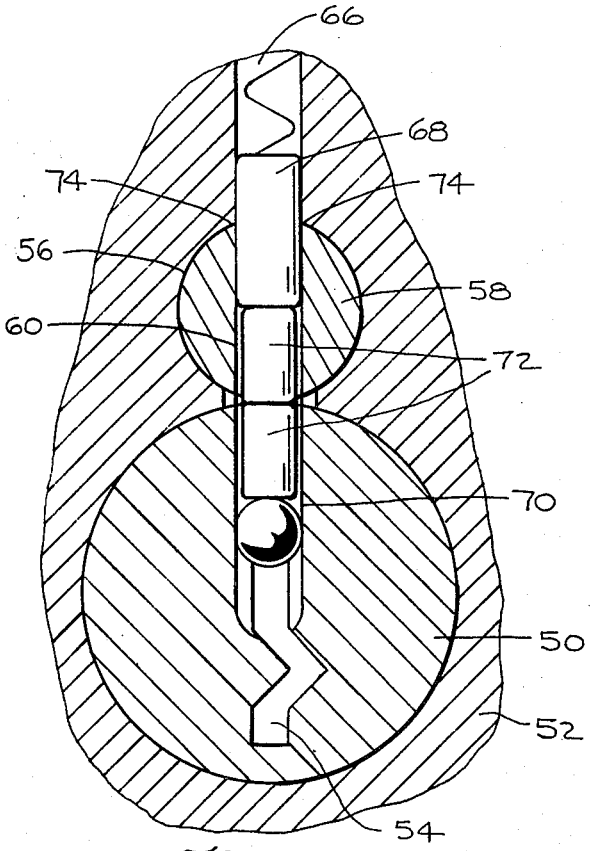

Although FIGS. 22 to 24 show a right-handed operation, a left-handed operation will operate in the same way but the insert 58 will be in a clockwise direction.

I claim:

1. A pin tumbler lock comprising an enclosure, a plug therein, a keyway in the plug, a set of pinways, a set of bottom and top pins in the pinways, and an insert riding on the exterior surface of the plug, the insert having an aperture therein to receive the top portion of the bottom pin, a sleeve surrounding the plug, a longitudinal recess in the sleeve at the interior surface thereof, said insert being movably located in said recess, top pins in the enclosure cooperating with the bottom pins, a longitudinal recess in the interior surface of the enclosure parallel with respect to the recess in the sleeve and at least one apertured insert movably mounted in said recess, for the reception of a top pin therein in general alignment with a corresponding bottom pin.

2. The pin tumbler lock of claim 1 including at least one additional insert apertured in the recess in the sleeve, said inserts being superposed.

3. The lock of claim 1 wherein the recess is wider than the inserts, the latter having a circumferential motion.

4. The lock of claim 1 wherein the sleeve recess is wider than the insert, the latter having a circumferential motion.

* * * * *